United States Patent [19]

Johnson

[11] Patent Number: 4,863,396

[45] Date of Patent: Sep. 5, 1989

[54] STRAIN RELIEF CLAMP ASSEMBLY

[76] Inventor: Lyle F. Johnson, 1407 SW. 17th Ter., Ft. Lauderdale, Fla. 33312

[21] Appl. No.: 712,928

[22] Filed: Mar. 18, 1985

Related U.S. Application Data

[63] Continuation of Ser. No. 273,411, Jun. 15, 1981, abandoned, which is a continuation-in-part of Ser. No. 95,216, Nov. 19, 1979, abandoned.

[51] Int. Cl.[4] ..... H01R 13/58

[52] U.S. Cl. ..... 431/470; 439/488

[58] Field of Search ..... 339/89 R-90 C, 339/91 B, 113 R, 103 R, 103 C, 103 M; 285/81, 87, 88; 439/320, 321, 470, 471, 488

[56] References Cited

U.S. PATENT DOCUMENTS

| | | | |
|---|---|---|---|
| 2,423,276 | 7/1947 | Weissman | 339/89 R |
| 3,505,635 | 4/1970 | Williams | 339/91 B |
| 3,732,527 | 5/1973 | McKnight | 339/103 M |
| 3,808,580 | 4/1974 | Johnson | 339/89 R |
| 4,066,314 | 1/1978 | Williams | 339/89 R |
| 4,239,314 | 12/1980 | Anderson et al. | 339/89 M |
| 4,808,123 | 2/1989 | Dee et al. | 439/470 |

FOREIGN PATENT DOCUMENTS

| | | | |
|---|---|---|---|
| 657986 | 7/1965 | Belgium | 339/89 R |
| 2033174 | 5/1980 | United Kingdom | 339/113 R |

*Primary Examiner*—Eugene F. Desmond

*Attorney, Agent, or Firm*—Malin, Haley & McHale

[57] ABSTRACT

A strain release clamp assembly consisting of a backshell component or female component member and a compression ring or male component member. The female component member is a generally cylindrical component having a plurality of radially directed bearing access ports therethrough for a screw-type adjusting member, a ball bearing, and an intermediate biasing means. The inside surface of the female member includes a concentric groove with an access channel to the outside surface for containing one side portion of a locking wire inserted through the access channel. The male member includes on the outside surface with a matching concentric groove for receiving the opposite side portion of the locking wire and includes a plurality of spaced apart ball bearing depressions. The female component member receives the male component member and is locked thereto by the locking wire. Unintentional relative rotation between the female component member and the male component is prevented by the ball bearings held in the depressions.

2 Claims, 2 Drawing Sheets

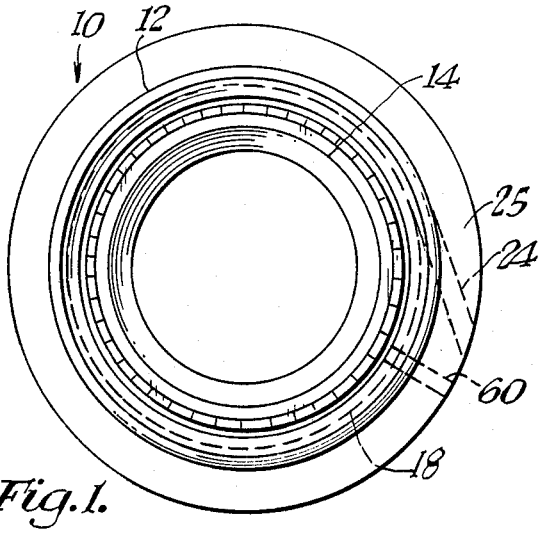
Fig.1.
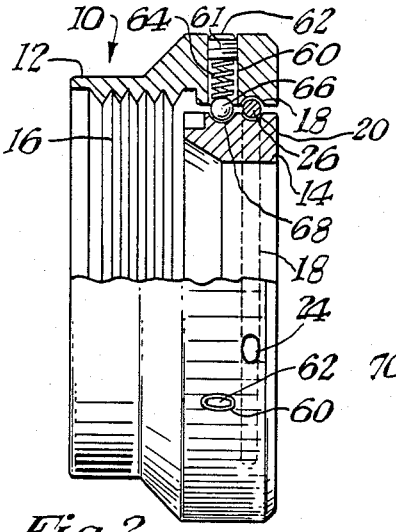
Fig.2.
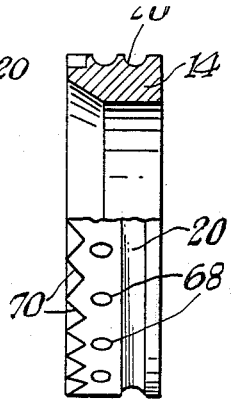
Fig.3.
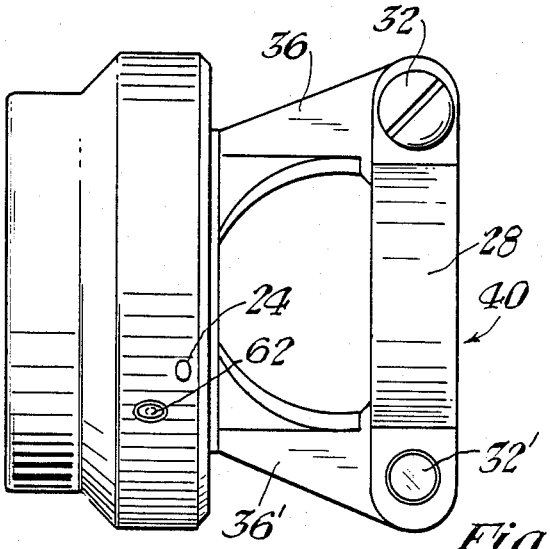
Fig.4.
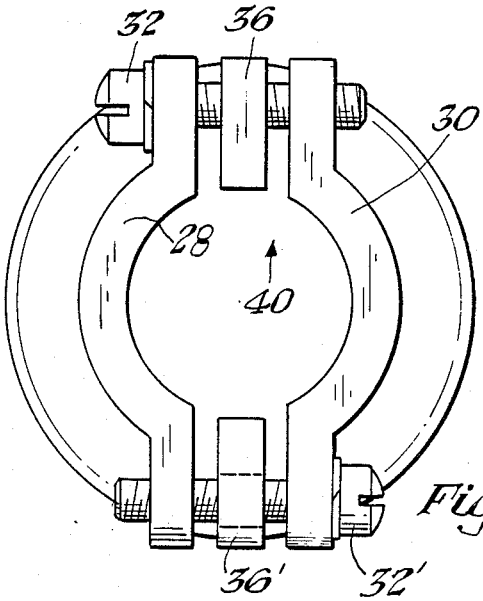
Fig.5.
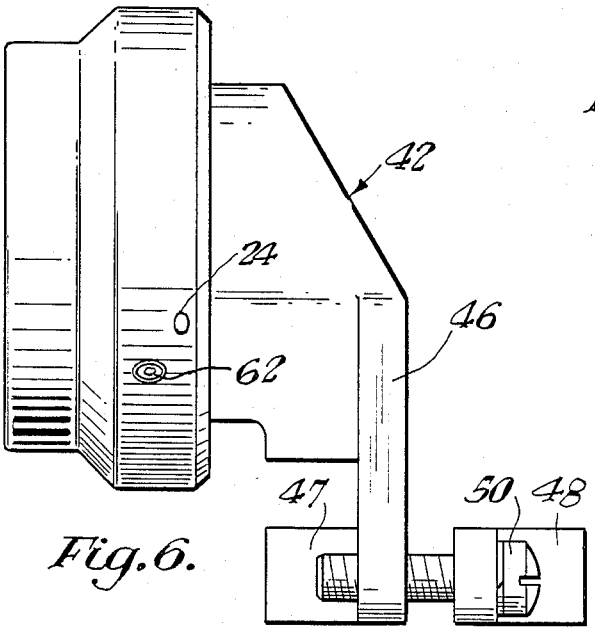
Fig.6.
Fig.7.
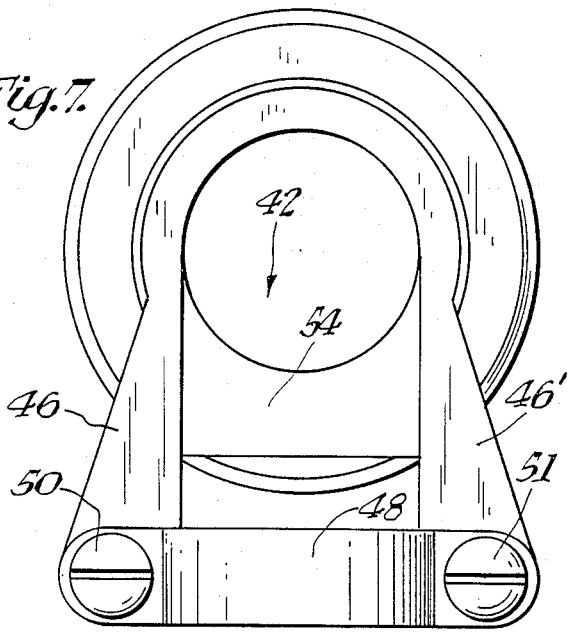

STRAIN RELIEF CLAMP ASSEMBLY

CROSS REFERENCES TO RELATED APPLICATIONS

This application is a continuation of application Ser. No. 273,411, filed 6/15/81, which is a continuation-in-part application of Ser. No. 95,216, filed Nov. 19, 1979, now abandoned.

BACKGROUND OF THE INVENTION

Prior art devices do not disclose the combined features of the invention disclosed herein. Reductions in the amount of tooling and special materials required to manufacture the strain relief clamp assembly disclosed herein will result in reductions in the price of the manufactured article. Prior art electrical connector accessory, such as U.S. Pat. No. 3,808,580 uses a "C"-shaped ring that is inserted into slots in each element of the connector assembly to provide a coupling which allows free rotation of the elements with respect to each other. The "C"-shaped ring must be inserted with special tooling during manufacturing.

The present invention eliminates the need for the use of the "C"-shaped rings and special tooling by providing a new and improved wire locking mechanism that uses a common wire that is easily installed after the components are assembled. The wire can be inserted through a small hole, leading to the grooves or slots in the members of the connector accessory. The new device may be assembled by hand without special tooling to insert the wire locking fastener into place. The wire locking fastener or device will not vibrate out of the small hole once it is inserted into the grooves.

U.S. Pat. No. 3,808,580 is incorporated by reference herein.

SUMMARY OF THE INVENTION

A strain relief clamp assembly comprising a cylindrical internally threaded coupler or female connecting member which is attached to an elbow wire clamping device by a wire locking device which fits into grooves or slots on both the female and male connecting members. The wire is inserted into these slots after the male and female connecting members are mated and aligned with each other. The wire is passed through a hole having an entrance in the outside of the female coupling member that leads into the grooves. This wire locking mechanism allows the backshell component female coupling nut member to be screwed onto an electrical connector without rotating the elbow or male component member. Each of the grooves are sized and shaped to contain a side portion of the locking wire that prevents relative axial movement of the strain relief clamp assembly sometimes referred herein as the accessory assembly or electrical connector accessory assembly.

The strain relief clamp assembly is assembled and locked together by a wire and is prevented from unintentional rotation by biased ball bearings means. The accessory assembly includes a first main part is a backshell component or female component member and the second main part is a compression ring or male component member. The female component member is a generally cylindrical coupling nut having connecting threads at one end and interconnecting means at the other end. The interconnecting means at the other end includes a plurality of radially directed bearing access ports therethrough. Each port includes an outside screw adjusting member, mating threads in the port, biasing member below the screw adjusting member, and a ball bearing partially positioned in the port below the biasing member.

The compression ring or male member is connected in the female member as set forth above. The male member includes on the outside surface a concentric groove that is positionable beneath the concentric groove in the female member. The concentric groove in the outside surface of the male member receives the opposite side portion of the locking wire. The outside surface of the male member also includes a plurality of concentrically spaced apart depressions in a row. The depressions are generally parallel to the concentric groove. The spaced apart depressions are positioned for receiving the opposite side portions of the spherical ball bearings that are partially in the bearing access ports. The ball bearings are biased down into the depressions to prevent unintentional relative rotation of the female and male members, such as is caused by vibration.

The male member also includes one end positioned in the female component member and a second end.

A clamp or elbow clamp is connected to the outside face. The clamp or elbow clamp is connectable to the wire bundle that passes through the electrical connector assembly. One end of the male member may include teeth for locking the position of the male member to the electrical connector that the female member is screwed upon.

To assemble the connector accessory assembly, the two parts are mated. When the grooves or slots are aligned over each other, a wire is passed through the aperture or hole in the wall of the female connector member to prevent the two elements from being pulled away from each other in an axial direction. The wire lock allows relative rotation of the two parts. The ball bearing means are adjusted to bias the ball bearings in the depressions to prevent intentional rotational movement between the two parts. The clamp or elbow clamp has a clamping mechanism which is tightened down on a wire bundle by turning the two screws on the clamp. A wire bundle is then connected to an electrical connector, such as a multi-pin connector, for example MIL-C-5015. The connector accessory to the back of the electrical connector male member to the accessory to allow the clamp to provide stress relief for the wire bundle.

It is an object of the present invention to provide a two element accessory assembly which is held together by an easily inserted locking wire.

It is another object of this invention to provide a two element accessory assembly which does not require a special mechanism to insert a locking means that permanently holds the two elements together but does not prevent relative rotation.

An additional object of the invention is to provide a ball bearing means or anti-decoupling device that eliminates the necessity of a safety wire that is connected between the coupling ring or nut and the clamp body.

In accordance with these and other objects which will be apparent hereinafter, the instant invention will now be described with particular reference to the accompanying drawings.

BRIEF DESCRIPTION OF THE DRAWINGS

In the drawing:

FIG. 1 is an end view of the accessory assembly.

FIG. 2 is a side view of the accessory assembly partially broken away.

FIG. 3 is a side view of the male component member partially broken away.

FIG. 4 is a side view of the accessory assembly with a straight through clamp device.

FIG. 5 is an end view of FIG. 4.

FIG. 6 is a side view of the accessory assembly with a ninety degree clamp elbow device.

FIG. 7 is an end view of FIG. 5.

DESCRIPTION OF THE PREFERRED EMBODIMENT

Figure 8:
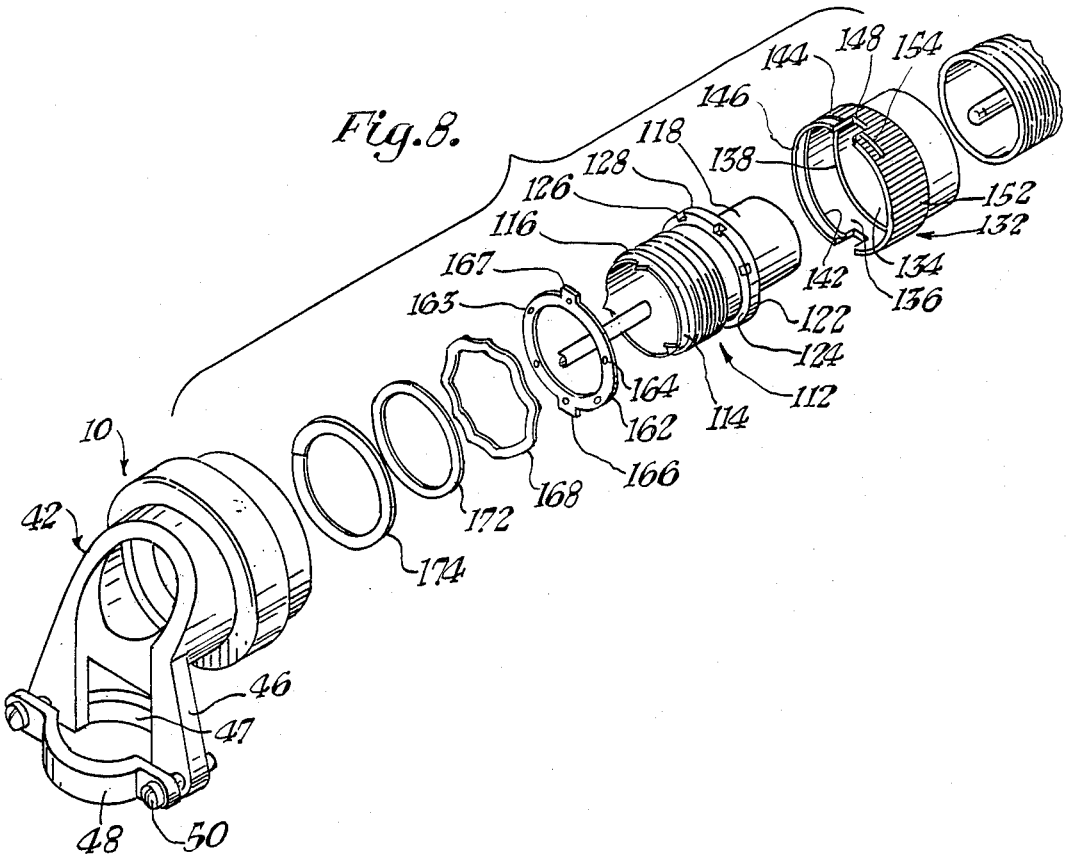
FIG. 8 is an exploded perspective view of an electrical connector shell and a self-locking coupling nut made in accordance with the invention.

Referring to FIGS. 1, 2, and 3, the strain relief clamp assembly or accessory assembly is generally referred to by numeral 10. The two elements or parts or main parts 12 and 14 of the accessory assembly are shown locked together in FIGS. 1 and 2. The female connector member or coupling ring 12 is locked over male member or clamp body 14. The female member 12 is a hollow cylindrical internally threaded member with threads 16 at one end. The threads 16 are used to screw the accessory assembly 10 on tightly to an electrical connector. The threads 16 are in the interior of the female component member 12.

The male component member 14 carries elbow wire clamping devices 40 and 42 as shown in FIGS. 4 through 7. The clamping devices in FIGS. 4 and 5 include a pair of legs 36 and 36' to which are connected two clamping bars 28 and 30. The clamping bars 28 and 30 are moved toward and away from one another by two screws 32 and 32'. When a wire bundle is passed between bars 28 and 30, and the screws are tightened, the wire bundle is held in place in the elbow clamping device 40. The wire bundle is thereby fixed to the male member 14.

The clamping devices in FIGS. 6 and 7 include a pair of legs 46 and 46' to which are connected two clamping bars 47 and 48. The clamping bar 48 is tightened by two screws 50 and 51. When a wire bundle is passed between bars 47 and 48 and the screws are tightened, the wire bundle is fixed in place in the ninety degree elbow clamping device. Support portion 54 will support the ninety degree bend of the wire bundle. Clamps having 45 degree elbows as well as other elbows may also be constructed in a similar manner.

The female connecting member or coupler 12 has a groove or slot 18 in its interior wall. The groove is also shown in dotted lines in FIGS. 1 and 2 with an aperture 24 having dotted lines in FIGS. 1 and 2 with an aperture 24 having channel 25 leading to groove 18. The wire locking device may be passed into aperture 24 through channel 24 to groove 18. The male member 14 has a groove or slot 20 on the outside surface. The channel in the female member 12 also leads into the groove 20 positioned as shown in FIG. 2. A locking wire 26 can be easily passed through hole 24 and into the grooves 18 and 20 when they are aligned with each other as shown in FIG. 2. The locking wire prevents the two members 12 and 14 from being axially pulled away from each other, that is, to the right and left as shown in FIG. 2. The wire locking device allows the male and female members to be freely rotated with respect to each other.

The female member 12 will rotate independently of the male member 14 and the locking wire positioned circumferentially around the elements is not twisted when the female member 12 is screwed on an electrical connector, not shown.

Unintended relative rotational movement between the female and male members 12 and 14 caused by vibrations is prevented by the ball bearing means that includes a plurality of radial openings 60 spaced about the female member. The ball bearing means includes the openings 60, threaded walls 61, an adjustable screw 62 connected to internal threads 61 now shown, biasing means or spring 64 and ball bearing 66. The male member 14 includes a plurality of spaced apart depressions 68. A depression is positioned below each ball bearing means. The depressions receive the lower portion of the ball bearings. The ball bearing means prevents relative radial movement of the female member 14 relative to male member 12 without first forcing the ball upward out of the depression against the biasing means or spring 64. The ball bearing means is an anti-decoupling device or a self-locking device which eliminates the necessity of safety wiring between the female connecting member and the wire clamp. In older devices without the ball bearing means, a wire hole had to be placed in member 12.

The male member 14 also includes teeth 70. The teeth are used to lock the position of the male member and the clamp to an electrical connector, not shown, to which the female member is connected.

The wire 26 is prevented from being removed from hole 24 by staking the hole 24 shut. This may be done using a hammer on a punch that is placed in contact with the body 12 adjacent the hole 24.

Referring now to the drawings, there is shown in FIG. 8, an exploded perspective view of a connector shell and a self-locking coupling nut made in accordance with principles of the invention substantially as shown in U.S. Pat. No. 3,808,580. The connector shell 112 comprises a rear cylindrical portion 114 which typically may be threaded on a portion of its outer surface 116 so as to accept male strain release clamp assembly 10. The connector shell 112 and coupling ring 132 are connected to mating receptacle 200 that mounts on a bulkhead or other terminal structure. The connector shell further comprises a front cylindrical portion 118. A radially extending flange 122 is formed integral with the cylindrical shell at the junction of the front cylindrical portion 118 and the rear cylindrical portion 114. The flange contains a front surface 123 and a rear surface 124. A plurality of radially formed indentations 126 extend inwardly from the rear surface 124 and radially to the flange outer surface 128.

A coupling nut 132 is adapted to be positioned over the connector shell 112 from the front end thereof and comprises a reduced diameter front bore portion 134 and an enlarged diameter rear bore portion 136. The junction of the front bore portion 134 and the rear bore portion 136 defines a rearwardly facing shoulder 138. An annular groove 142 is formed at the rear end of the rear bore portion 136. A pair of notches 144 are formed in the rear bore portion 136 of the coupling nut and extend from the rear surface 146 of the coupling nut to a rearwardly facing shoulder 148. The notches 144 are normally formed 180° apart on the connector shell The outer surface 152 of the rear bore portion is knurled to facilitate rotation of the coupling nut 132. In addition, circumferentially extending raised indicator members 154 are positioned on the outer surface 152 and extend on either side of the notches 144. The front bore portion 134 of the coupling nut 132 contains threads 156.

A clutch plate 162 is formed of a cylindrical disc whose front surface 163 contains a plurality of protrusions 164 which extend in a forward direction. The disc is mounted on the outer surface of the rear cylindrical portion 114 of the shell with the front surface 163 abutting the surface 124. The clutch plate also contains a pair of outwardly extending flanges 166 which are positioned in the notches 144 and abut the shoulder 143. The outer surface 167 of the flanges is flush with the knurled outer surface 152. A wave spring 168, having a disc shape, is positioned behind the clutch plate 162. Positioned behind the wave spring 168 is a washer 172. The washer 172 is secured in the rear bore portion 136 by means of a retaining ring 174 which is positioned in the annular groove 142.

Figure 9:
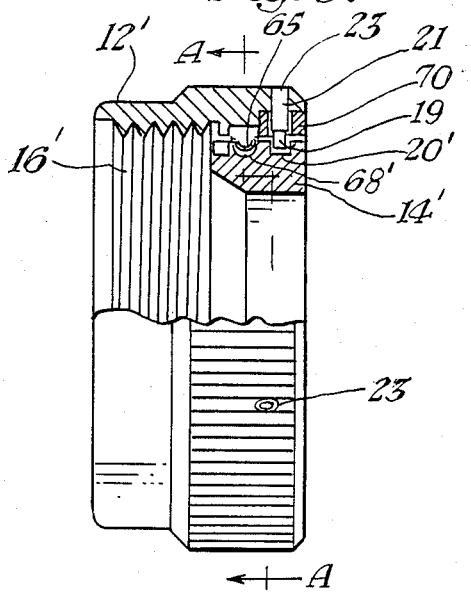
FIG. 9 is a side view of an alternate embodiment of the accessory assembly partially broken away.
Figure 10:
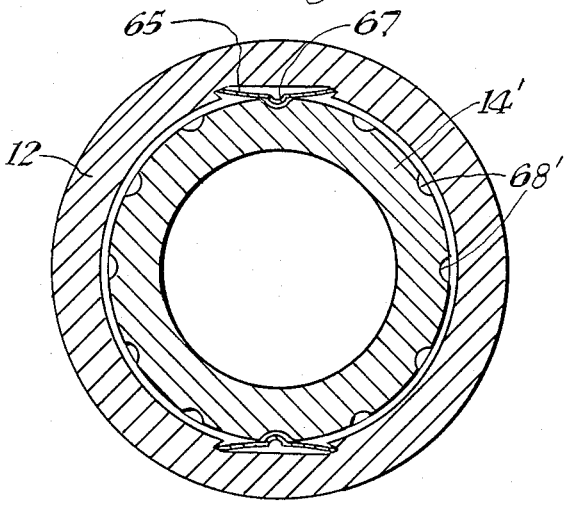
FIG. 10 is a cross-sectional view of FIG. 9 taken across the line A and looking in the direction of the arrows.

Referring to FIGS. 9 and 10 the electrical connector accessory assembly is shown. The coupling nut 12' and cable clamp body 14' of the connector are shown locked together in FIGS. 9 and 10. The female connector member or coupling ring 12' is locked over male member or clamp body 14'. The female member 12' is a hollow cylindrical internally threaded member with threads 16' at one end. The threads 16' are used to screw the electrical connector accessory assembly 10'' (see FIG. 8) on tightly to an electrical connector. The threads 16' are in the interior of the female component member 12'.

The female connecting member or coupler 12' has spring retainer grooves or notches in its interior wall. The spring retainer groove is sized to allow flexing of the anti-rotation springs 65. The anti-rotation springs 65 are held in place by the retaining ring 70. The spring retaining ring 70 is held in place by the set screw retainer 21 which threads into the aperture 23 and through the ring 70. The cable clamp body includes a rectangular groove 20' which accepts the dog end 19 of the set screw retainer 21, yet will allow the coupling ring to rotate freely.

Each of the anti-rotation springs 65 includes a coined round dimple 67 which engages with one of a plurality of anti-rotation detents 68'. Smaller sized assemblies will normally require at least two springs and larger sizes will require three springs.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A wireless automatic self-locking anti decoupling nut for a strain relief clamp accessory for an electrical connector and a wire bundle, the clamp accessory adapted for attachment to an electrical connector, said automatic self-locking anti decoupling nut to prevent decoupling from said electrical connector due to vibration, comprising:

a first member with an outer surface and mating means for mating with the electrical connector;

a second member rotatably connected in said first member, said second member including electrical connector locking means for preventing relative movement between said second member and the electrical connector when engaged, said second member including strain clamp for clamping the wire bundle having wires connecting with the electrical connector;

said first member including a concentric inner surface for at least partially receiving said second member;

said inner surface including a first groove, and a channel connected between said first groove and the outer surface of said first member;

said second member including a concentric outer surface and a second groove in said concentric outer surface;

a locking member positioned in said first groove and said second groove by passing through said channel after said first groove and said second groove are aligned, said locking member prevents axial separation and allowing relative rotational movement between said first member and said second member;

automatic means for withstanding vibration and unintentional relative rotational movement between said first member and said second member;

said automatic means includes a spherical ball bearing for withstanding vibration and unintentional relative rotational movement between said first member and said second member, said concentric outer surface of said second member including three or more depressions having a spherical shape for receiving said spherical ball bearing;

said ball spherical bearing includes at least one radial opening through said first member, an adjustable spring in said opening for adjusting the pressure exerted by said ball bearing means to change the torque required to provide relative rotation between said first member and said second member, and a spherical ball bearing positioned below said biasing means for movement into and out of said depressions;

said first groove, said second groove, and said locking member are sized to position one side of said locking member in said first groove and another side of said locking member in said second groove, said channel including a blocking means for holding said locking member in said first groove and said second groove;

said ball bearing means is an adjustable screw device with spring positioned between said screw device and said ball bearing;

said electrical connector locking means is a gear type mating device, and said strain clamp has a clamping device to hold wire bundle in reference to the electrical connector and adapted to provide quick response time for preventing labor lost on all airplanes due to safety wiring to lock the accessory to the electrical connector.

2. An automatic self-locking anti decoupling nut for a strain relief clamp accessory for an electrical connector and a wire bundle, the clamp assembly adapted to attachment to an electrical connector, said automatic self-locking anti decoupling nut to prevent decoupling from said electrical connector due to vibration, comprising:

a first member with an outer surface and mating means for mating with the electrical connector;

a second member rotatably connected in said first member, said second member including electrical connector locking means for preventing relative movement between said second member and the electrical connector when engaged, said second member including strain clamp for clamping the wire bundle having wires connecting with the electrical connector;

said first member including a concentric inner surface for at least partially receiving said second member;

said concentric inner surface including at least one retainer groove, and at least one anti-rotation spring means for engaging said second member and for preventing vibration and unintentional relative rotational movement between said first member and said second member each said anti-rotation spring means operably connected in a respective retainer groove, each said retainer groove sized and shaped to allow flexure of said anti-rotation spring means;

said first member having at least one threaded aperture, each threaded aperture having a set screw therein and said first member including a retainer means in a respective retaining groove, said retainer means including an aperture concentrically aligned with a respective threaded aperture in said first member to allow passage of a respective set screw such that said retainer means is held in place;

said second member including a concentric outer surface having a set screw groove for receiving a portion of said set screw, preventing axial separation and allowing relative rotational movement between said first member and said second member, each said anti-rotation spring means is a flexible, elongated member having a spherical dimple, and said concentric outer surface including three or more depressions having spherical shapes, each said depression for receiving a respective spherical dimple.

* * * * *